US008096631B2

(12) United States Patent
Kunimatsu

(10) Patent No.: US 8,096,631 B2
(45) Date of Patent: Jan. 17, 2012

(54) INK-JET TYPE IMAGE-FORMING APPARATUS AND INK-JET TYPE IMAGE-FORMING METHOD

(75) Inventor: Miho Kunimatsu, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 987 days.

(21) Appl. No.: 12/036,089

(22) Filed: Feb. 22, 2008

(65) Prior Publication Data

US 2008/0218544 A1 Sep. 11, 2008

(30) Foreign Application Priority Data

Mar. 6, 2007 (JP) ..... 2007-055858

(51) Int. Cl.
*B41J 29/38* (2006.01)

(52) U.S. Cl. ..... 347/9; 347/12

(58) Field of Classification Search ..... 347/9, 12
See application file for complete search history.

(56) References Cited

U.S. PATENT DOCUMENTS

| | | | | |
|---|---|---|---|---|
| 5,440,410 | A * | 8/1995 | Sugishima | 358/502 |
| 5,477,245 | A * | 12/1995 | Fuse | 347/10 |
| 6,019,448 | A * | 2/2000 | Yano et al. | 347/12 |

FOREIGN PATENT DOCUMENTS

| | | | |
|---|---|---|---|
| JP | 08-025618 | A | 1/1996 |
| JP | 2001-038926 | A | 2/2001 |
| JP | 2001-293856 | A | 10/2001 |
| JP | 2002-113845 | | 4/2002 |
| JP | 2004-106253 | A | 4/2004 |
| JP | 2005-059312 | A | 3/2005 |

* cited by examiner

*Primary Examiner* — Omar Rojas

(74) *Attorney, Agent, or Firm* — patenttm.us

(57) ABSTRACT

An image-forming apparatus is provided which prevents irregularity of an image density and improves the life of heating elements. In a half of recording heads (a group of recording heads 22K2, 22K4, 22K6 not adjacent to each other), off time T2 is shortened at a timing of PWM renewal 1; in the other recording heads (22K1, 22K3, 22K5, another group of the recording heads not adjacent to each other) the off time T2 is not changed at the timing of PWM renewal 1 but is shortened at the timing of PWM renewal 2. As the result, in the region corresponding to the timing from PWM renewal 1 to PWM renewal 2, the amount of the ink droplets ejected from the nozzles of the recording heads 22K2, 22K4, 22K6 is decreased to decrease slightly invisibly the image density formed by the ink droplets ejected from the nozzles 22K2, 22K4, 22K6.

5 Claims, 16 Drawing Sheets

Fig.7

| Temperature(℃) | T2(μ sec) | T3(μ sec) |
|---|---|---|
| 30~33 | 2 | 0 |
| ~35 | 1 | 0 |
| ~37 | 0.75 | 0 |
| ~39 | 0.5 | 0 |
| ~41 | 0.25 | 0 |
| ~43 | 0.15 | 0 |
| ~45 | 0 | -0.1 |
| ~47 | 0 | -0.3 |
| ~49 | 0 | -0.4 |
| ~51 | 0 | -0.45 |
| ~53 | 0 | -0.55 |
| 53~ | 0 | -0.6 |

INK-JET TYPE IMAGE-FORMING APPARATUS AND INK-JET TYPE IMAGE-FORMING METHOD

TECHNICAL FIELD

The present invention relates to an ink-jet type image-forming apparatus which forms an image by ejecting an ink onto a recording medium through plural nozzles on a recording head, and relates also to an ink-jet type image-forming method employing the apparatus.

BACKGROUND TECHNIQUES

Ink-jet types of image-forming apparatuses are widely used for forming an image on a recording medium by ejection of an ink from ink-ejecting nozzles of a recording head. In such an ink-jet type of image-forming apparatus, a heater element is provided on the inside wall of the respective nozzles, and electric pulses are applied selectively to the heater element to cause bubbling of the ink by film boiling in correspondence with the image to be recorded to eject an ink droplet through the nozzle.

An image can be recorded on a long recording medium sheet (e.g., several meters long) with such an ink-jet type image-forming apparatus. In the recording on a long recording medium sheet, the ink is ejected repeatedly over a long time from the nozzles of the recording head by applying electric pulses repeatedly to the heater elements in the nozzles. Thereby, the thermal energy applied to the ink in the nozzles can not dissipate sufficiently to cause rise of the temperature of the recording head and the ink in the nozzles. This rise of temperature of the ink will increase the amount of the ink droplet (size of the droplet) ejected from the nozzle in one ink ejection. Furthermore, excessive rise of the temperature of the recording head causes decrease of the surface tension of the ink to prevent the ink meniscus formation at the nozzle outlet (ink ejection outlet) to cause defects in the recorded image.

To prevent such a trouble in an ink-jet type image-forming apparatus, the inside temperature of the recording head is detected and the temperature of the recording head is kept below a prescribed temperature by changing the widths of the electric pulses applied to the heater element or by decreasing the delivery speed of the recording medium. (e.g., JP2002-113845A).

When the width of the electric pulse applied to the heater element is changed as mentioned above (when the thermal energy applied to the ink in the nozzle is changed), the amount of the ink droplet ejected from the nozzle is changed during the image formation on one sheet of the recording medium to cause irregularity of the image density on the one recording medium sheet. On the other hand, when the width of the electric pulse is kept unchanged to avoid the above irregularity of the image density, the heater element is overheated to cause adverse effect on the life of the heater element.

DISCLOSURE OF THE INVENTION

Under such circumstances, the present invention intends to provide an ink-jet type of image-forming apparatus which does not cause irregularity of the image density, and an ink-jet type image-forming method employing the apparatus irregularity.

For achieving the above intention, the present invention has been achieved in an ink-jet type image-forming apparatus in which recording heads having respectively a plurality of nozzles for ink ejection are provided and thermal energy is applied to ink in the nozzles to eject droplets of the ink from the nozzles onto a recording medium to form an image thereon by switching driving conditions for applying the thermal energy to the ink:

(1) the apparatus comprising a controller for controlling the driving conditions not to switch simultaneously in all the nozzles for ejecting the ink droplets of the ink for forming the image in a region of a prescribed length of the recording medium in the direction of delivery of the recording medium.

(2) The region may be is constituted of plural bands extending perpendicularly to the direction of delivery of the recording medium.

(3) The region may have a length larger than the prescribed length. The prescribed length is preferably 10 mm.

(4) The controller may classify the nozzles into groups and changes timing for switching the driving conditions for each of the groups of the nozzles.

(5) The nozzles may be arranged in rows perpendicular to the direction of delivery of the recording medium.

(6) The controller may classify the nozzles into groups not to contain adjacent rows of the nozzles in the same group, and changes the timing for switching the driving conditions for each of the groups of the rows.

(7) The thermal energy may be controlled to cause difference between the image densities of the adjacent images formed by the ink droplets ejected from adjacent groups of the nozzles within a prescribed density difference range.

(8) The controller may classify the nozzles into groups to form, with the ink ejected from one group of the nozzles, an image constituted of 100 or less picture elements or an image having a side length of 4 mm or less.

(9) The controller may control the timing for switching the driving conditions for the ink in the adjacent nozzles.

(10) The controller conducts the control to increase successively the number of the nozzles having the driving conditions switched.

(11) The nozzles may eject one common color of ink.

(12) The controller may switch the driving conditions based on the temperature of the recording head.

The aforementioned object can be achieved by the ink-jet type image-forming method in which recording heads having respectively a plurality of nozzles for ink ejection are provided and thermal energy is applied to ink in the nozzles to eject droplets of the ink from the nozzles onto a recording medium to form an image thereon with switching of driving conditions for applying the thermal energy to the ink,

(13) the driving conditions are controlled not to switch simultaneously in all the nozzles for ejecting the droplets of the ink for forming the image in a region of a prescribed length of the recording medium in the direction of delivery of the recording medium.

(14) The region may be constituted of plural bands extending perpendicularly to the direction of delivery of the recording medium.

(15) The region may have a length larger than the prescribed length.

(16) The controller may classify the nozzles into groups and changes the timing of switching the driving conditions for each of the groups of the nozzles without changing simultaneously the thermal energy applied to the ink in the respective nozzles.

(17) The nozzles may be arranged in rows perpendicular to the direction of delivery of the recording medium and the rows are arranged along the direction of delivery of the recording medium, and

(18) the nozzles are classified into groups not to contain adjacent rows in the same group, and the timing of switching the driving conditions are changed for each of the groups of the rows.

(19) The driving conditions may be switched to cause difference in the image densities between the adjacent images formed by the ink droplets ejected from adjacent groups of the nozzles within a prescribed image density difference range.

(20) The nozzles may be classified into groups to form, with the ink ejected from one group of the nozzles, an image constituted of 100 or less picture elements or an image having a side length of 4 mm or less.

(21) The thermal energy applied to the ink contained in adjacent nozzles of the plurality of the nozzles may be changed at different timings.

(22) The driving conditions may be controlled to increase successively the number of the nozzles having the driving conditions switched.

(23) The nozzles may eject one common color of ink.

(24) The driving conditions may be switched based on the temperature of the recording head.

According to the present invention, in formation of an image in a region of a recording medium of a certain length in the direction of delivery of the recording medium, the driving conditions of the nozzles are not simultaneously switched for ejection of ink droplets. Thus, the density of the image formed in the region is not changed abruptly between the image portions recorded before and after the switching of the driving conditions. Thereby, the boundary of the image density change in the image formed on one sheet of the recording medium is not visibly recognizable, whereby density irregularity and drop of the image quality are prevented.

BRIEF DESCRIPTION OF THE DRAWINGS

FIG. 7 is an example of the PWM table showing the relation of the temperature of the recording head with the pulse time.

BEST MODE FOR CARRYING OUT THE INVENTION

The present invention is made for an ink-jet type image-forming apparatus having plural long recording heads.

Example 1

A printer is described as an example of the ink-jet type image-forming apparatus of the present invention.

Figure 1:
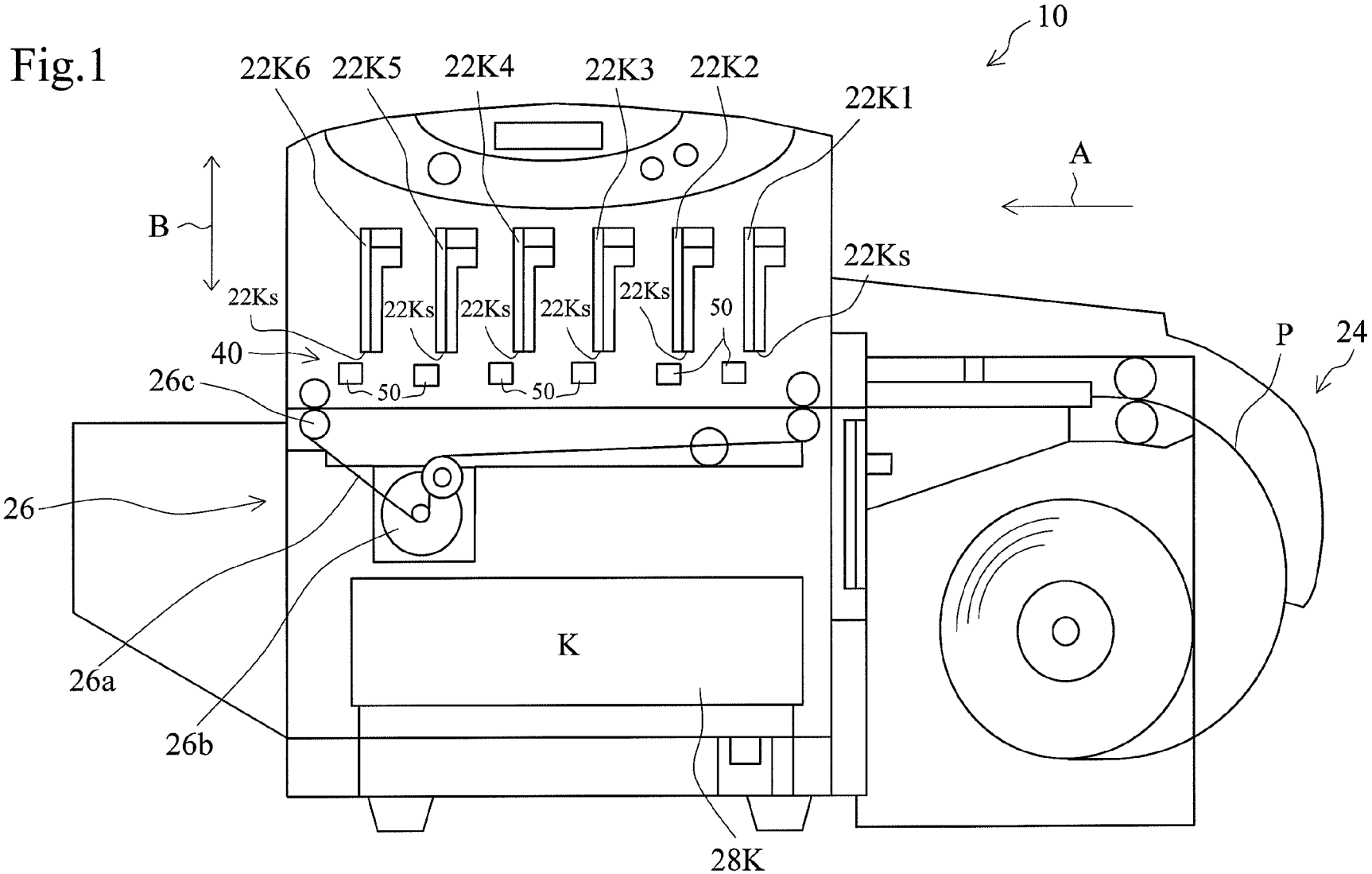
FIG. 1 is a schematic front view of a printer, an example of the ink-jet type image-forming apparatus of the present invention.

FIG. 1 is a schematic front view of a printer, an example of the ink-jet type image-forming apparatus of the present invention.

Figure 2:
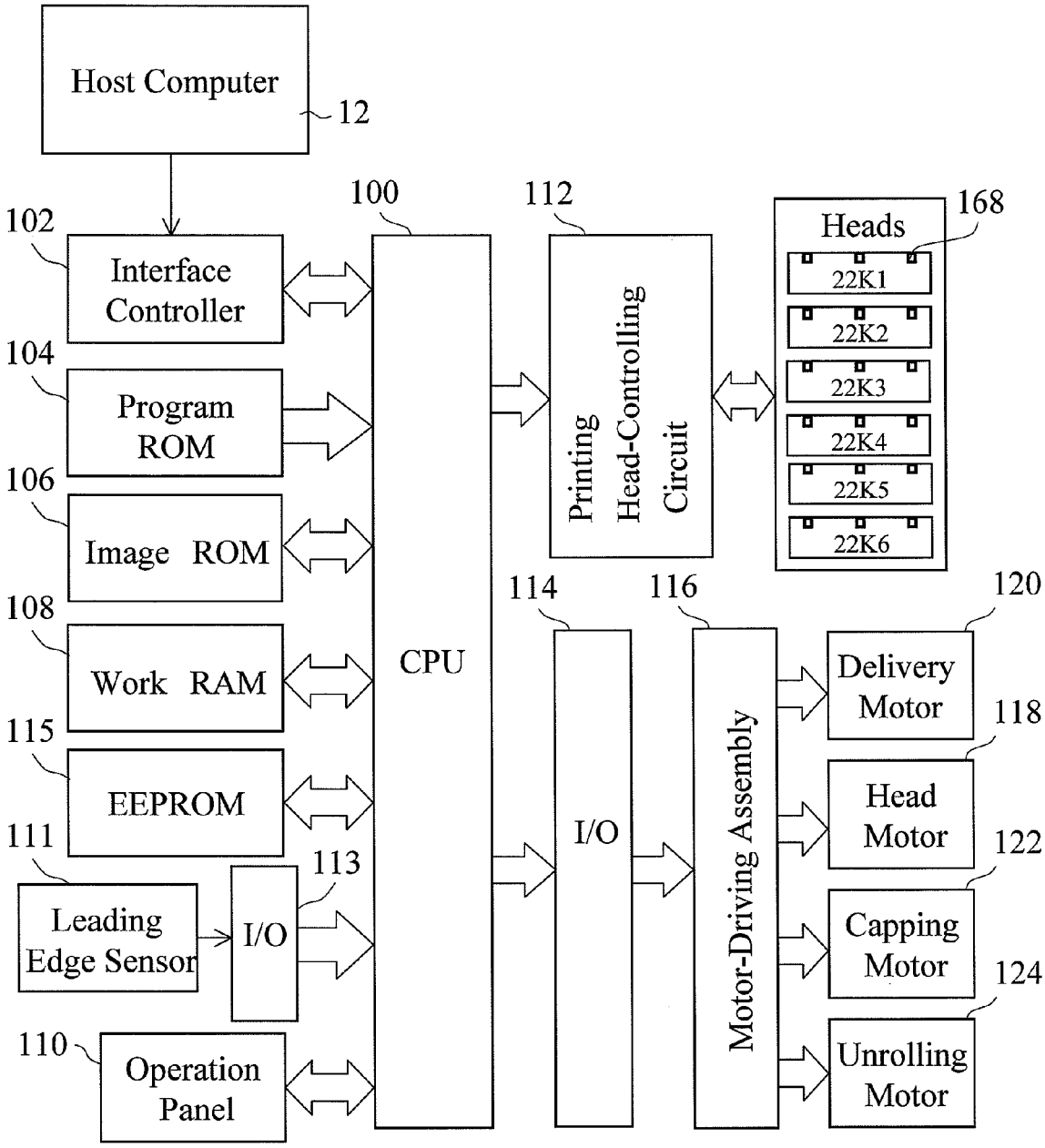
FIG. 2 is a block diagram of an electric system of the printer illustrated in FIG. 1.

A printer 10 is connected to a host computer 12 (personal computer, FIG. 2). The host computer 12 transmits image information to the printer 10. The printer 10 has six recording heads 22K1, 22K2, 22K3, 22K4, 22K5, 22K6 which are arranged in the direction of the delivery (arrow-A direction) of a recording medium P (rolled paper sheet in this Example). The six recording heads 22K1-22K6 respectively eject a black ink. These six recording heads 22K1-22K6 are respectively a line-head, extending perpendicularly to the paper sheet face of the drawing of FIG. 1 (perpendicular to arrow-A direction). The length of the respective printing heads 22K1-22K6 is a little larger than the full width of the recording medium for printing by the printer 10 (the length in the direction perpendicular to the drawing sheet face of FIG. 1). The six printing heads 22K1-22K6 are fixed (not moved) during image formation.

The printer 10 incorporates a recovery unit 40 for stable ink ejection through the six printing heads 22K1-22K6. This recovery unit 40 recovers the initial ejection state of the printing heads 22K1-22K6. The recovery unit 40 has capping mechanisms 50 for removing the ink, for ejection recovery, from the front faces 22Ks of ejection nozzles 22K1-22K6. The capping mechanisms 50 are provided separately for the respective printing heads 22K1-22K6, and comprise respectively a wiper blade, a blade-holding member, and a cap.

A rolled paper sheet P is fed from a rolled paper-feeding unit 24, and is delivered in the arrow-A direction by a delivery mechanism 26 incorporated in the printer 10. The delivery mechanism 26 incorporates a delivery belt 26*a* for delivering the rolled paper sheet P, a delivery motor 26*b* for circulating the delivery belt 26*a*, and a tension roller 26*c* for applying tension to the delivery belt 26*a*.

For forming an image on the rolled paper sheet P, the record-starting position of the rolled paper sheet P is brought under the black printing head 22K1, and a black ink is selectively ejected through the printing head 22K1 in accordance with the recording data (image information). Thereafter, similarly the black ink is ejected through the printing heads 22K2, 22K3, 22K4, 22K5, 22K6 in the named order to form an image on the rolled paper sheet P. The printer 10 includes, in addition to the aforementioned parts and members, main tanks 28K for storing ink to be supplied to the printing heads 22K1-22K6, pumps (not shown I the drawing) for supplying the ink to the printing heads 22K1-22K6 and for the recovery operation.

The electric system of the printer 10 is explained with reference to FIG. 2.

FIG. 2 is a block diagram showing the electric system of the printer shown in FIG. 1.

The data or commands for recording are transmitted from the host PC 12 through an interface controller 102 to a CPU 100. The CPU 100 is a central processing unit for controlling the printer 10 as a whole such as reception of recording data, operation of recording, and handling of the rolled paper sheet P. The CPU 100, after analyzing received commands, develops the image data of the respective color as a bit map in the image memory 106 for drawing an image. As the operation prior to the recording, a capping motor 122 and a head-moving motor 118 (head motor) are driven through an input-output port (I/O) 114 and a motor-driving assembly 116 to move the recording heads 22K1-22K6 apart from the capping mechanisms 50 to the recording position (image formation position).

Then an unrolling motor 124 for sending out the rolled paper sheet P and a delivery motor 120 for delivering the rolled paper sheet P at a low delivery rate are driven by the output port 114 and the motor-driving assembly 116 to deliver the rolled paper sheet P to the recording position. The leading edge of the rolled paper sheet is detected by a leading edge-detecting sensor 111 to determine the timing of ejection of the ink onto the paper sheet P being delivered at a constant rate. Thereafter, in synchronization with the delivery of the rolled paper sheet P, the CPU 100 reads out corresponding color recording data from the image memory 106 successively, and transmits the read-out data through a printing head-controlling circuit 112 to the respective printing heads 22K1-22K6.

The CPU 100 functions in accordance with the processing program memorized in a program ROM 104. The program ROM 104 memorizes the processing program and the tables corresponding to the control flow. A work RAM 108 is used as the operation memory. In the operations for cleaning and recovery of the respective printing heads 22K1-22K6, the CPU 100 controls ink pressurization and ink suction by driving a pump motor (not shown in the drawing) 124 through an output port 114 and a motor-driving assembly 116.

The recording heads 22K1-22K6 have respectively plural nozzles for ink ejection. Each of the recording heads (e.g., recording head 22K1) has the nozzles arranged in a row in the direction perpendicular to the delivery direction of the recording medium (arrow-A direction in FIG. 1). Therefore in the entirety of the recording heads 22K1-22K6, the plural nozzles are arranged in rows perpendicular to the direction of the recording medium delivery and the six rows of the nozzles are arranged in the direction of the recording medium delivery. Since the nozzles are identical in the construction, one nozzle 22K1*n* of the recording head 22K1 is described with reference to FIG. 3.

Figure 3:
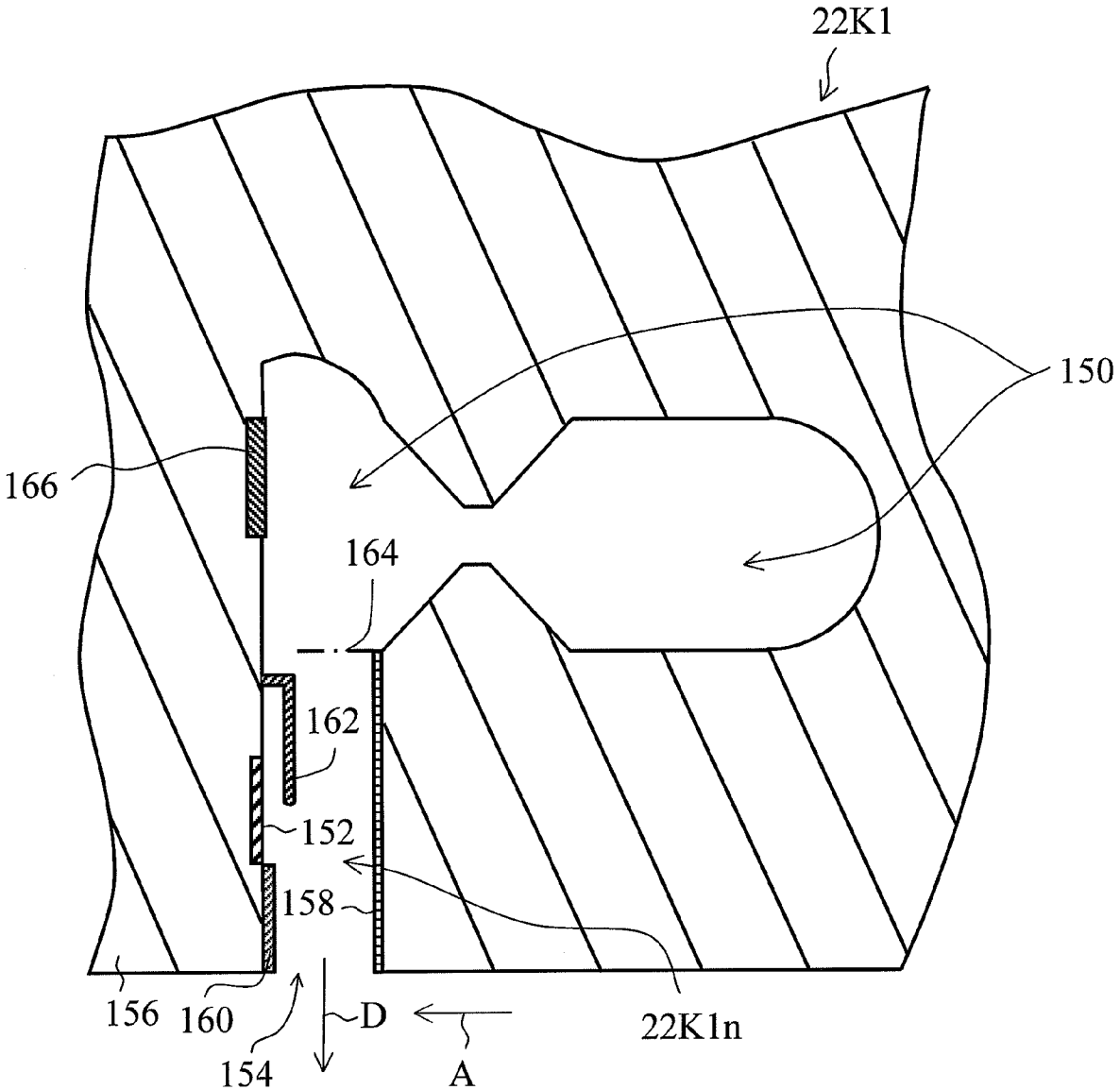
FIG. 3 is a sectional view of a nozzle and a peripheral part thereof.

FIG. 3 is a sectional view of the nozzle and the peripheral part thereof. FIG. 3 illustrates one nozzle 22K1*n*. The recording head 22K1 has many nozzles arranged in a row in the length direction of the recording head (recording medium width direction).

The recording head 22K1 has many nozzles 22K1*n* for ink ejection arranged in the direction perpendicular to the paper sheet face of FIG. 3. These nozzles 22K1*n* are communicated to a common ink chamber 150 containing the ink. This common ink chamber 150 is connected to a sub-tank (not shown in the drawing). The ink is fed from the sub-tank to the common ink chamber 150.

Nozzles 22K1*n* have respectively a heater 152 for bubbling the ink in the nozzle 22K1*n*. A thermal energy is applied to the ink in the nozzle 22K1*n* to cause bubbling of the ink by energizing the heater 152. Thereby a droplet of the ink is pushed and ejected from the outlet (ink outlet 154) of nozzle 22K1*n*. The heater 152 is provided on the silicon element substrate 156 by a conventional method. A silicon top plate 158 and a nozzle 1160 are formed on the silicon element substrate 156 for uniformizing the wetting property of the ink near the meniscus M. The silicon top plate 158 and the nozzle 1160 are placed on the inside wall of nozzle 22K1*n*. The silicon top plate 158 and nozzle 1160 are coated with a resin. The nozzle 1160 is placed on the inside wall near the ink ejection outlet 154 of the nozzle 22K1*n* to narrow the nozzle 22K1*n*.

The common ink chamber 150 is also formed in the silicon element substrate 156. Further, a valve 162 for directing the ink on bubbling by the heater 152 efficiently to the ink ejection direction (arrow-D direction), and a flow path wall 164 extending perpendicularly from the silicon top plate 158 inward are formed in the silicon element substrate 156. The nozzle 1160 is provided to prevent chipping of the silicon top plate 158 in cutting operation in production of plural nozzles 22K1*n*. A sub-heater 166 is provided at a portion of the silicon element substrate 156 in opposition to the common ink chamber 150. This sub-heater 166 is provided to keep the ink in the recording head 22K1*n* at a constant temperature to stabilize the viscosity of the ink and to enable printing within the stabilized ejection range.

The heater 152 is formed by patterning of a resistance layer and wiring. The heater 152 is energized by applying a voltage through this wiring to the resistance layer to generate heat in the heater. The generated heat applies thermal energy to the ink around the heater 152 to cause bubbling of the ink and ejects the ink through the ink ejection outlet 154. Additionally, a plurality of Di sensors 168 (FIG. 4) are provided on the silicon element substrate 156 for detecting the temperature of the thermal energy accumulated in the silicon element substrate 156 and the heater 152. The driving conditions of the recording head 22K1 are determined based on the temperature detected by the Di sensors 168. The driving conditions are described later. One ink droplet ejected from the nozzle 22K1*n*, on impact against the recording medium, prints one picture element.

Figure 4:
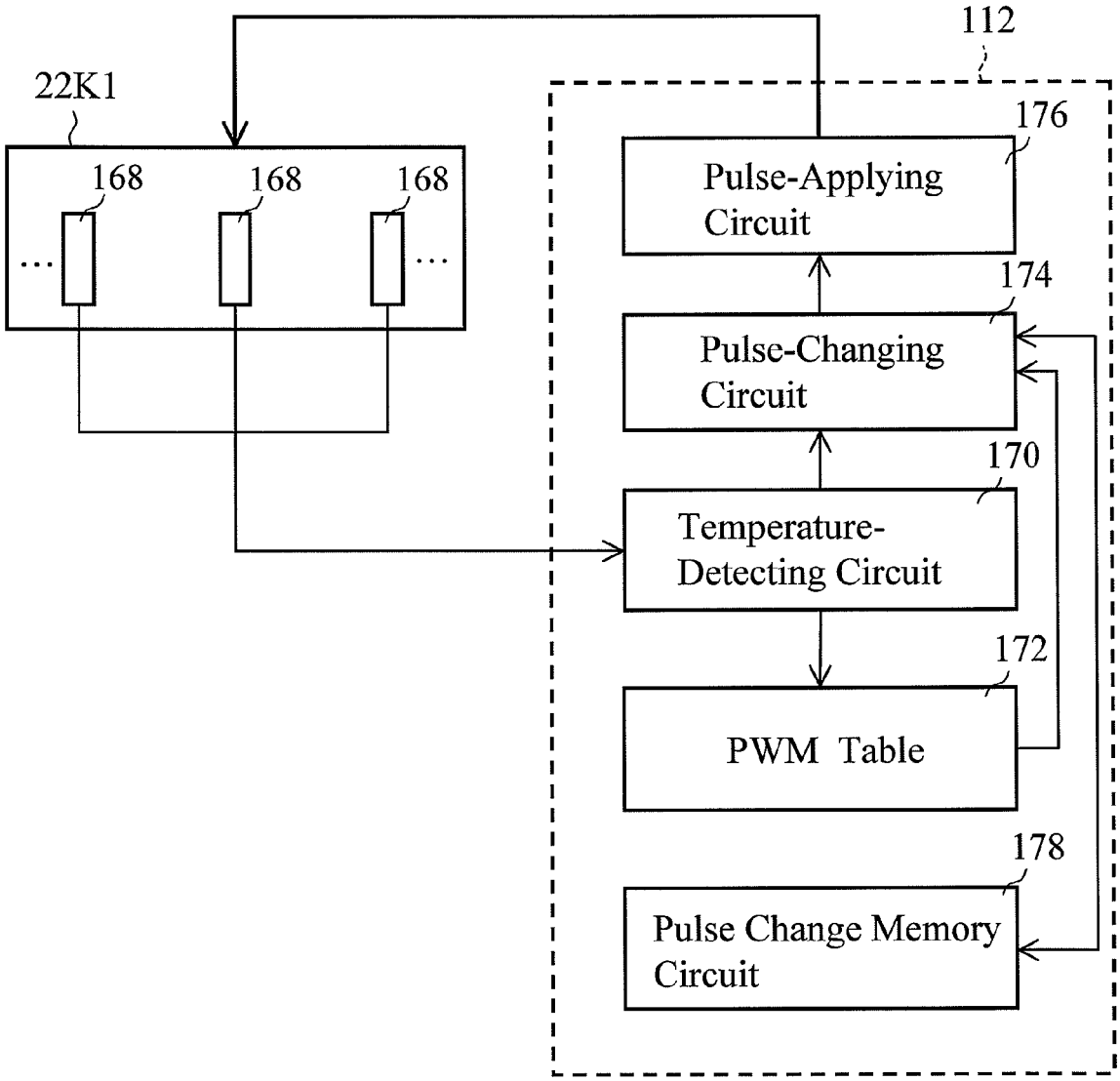
FIG. 4 is a block diagram of an electric system for determining the driving conditions of a recording head by measuring the temperature of the recording head.

An electric system is described for determining the driving conditions of a recording head based on the measured temperature of a recording head with reference to FIG. 4.

FIG. 4 is a block diagram of an electric system for determining the driving conditions of a recording head based on the measured temperature of a recording head.

As described above, plural Di sensors 168 (three sensors in FIG. 4) are provided in a recording head (22K1). A signal from this Di sensor 168 is transmitted to a temperature-detecting circuit 170 contained in a recording head-controlling circuit 112 to detect the temperature of the ink in the nozzle 22K1. According to the detected temperature, a pulse is selected from PMW table 172 as described later. The signal of the selected pulse is transmitted to a pulse-changing circuit 174. The pulse-changing circuit 174 selects a heater 152 (FIG. 3) for changing the pulse and transmits this signal to a pulse-applying circuit 176 according to the driving conditions mentioned later (conditions of the electric pulse to be applied to the heater 152 and conditions of application of the thermal energy). The pulse-applying circuit 176 applies the pulse to the heater 152 of the respective nozzles to allow the heater 152 to generate heat. The nozzle in which the applied pulse has been changed by the pulse-changing circuit 174 is memorized in a pulse change-memorizing circuit 178. Thus, the specific nozzle in which the pulse is changed and the time of the change are memorized by the recording head-controlling circuit 112.

In switching (changing) the above driving conditions, all the nozzles in one row in one recording head (e.g., in recording head 22K1) may be driven as one group (in one unit), and the driving conditions for all of the nozzles in this group (the conditions of the electric pulses applied to heater 152 of the individual nozzles) may be changed simultaneously. Otherwise, nozzles in separate rows not adjacent (e.g., recording heads 22K1, 22K3, and 22K5) may be handled as one nozzle group, and the driving conditions for all of the nozzles in this nozzle group may be changed simultaneously. Or the nozzles in one recording head may be classified into nozzle groups, and the driving conditions may be switched (changed) for the respective nozzle groups.

Figure 5:
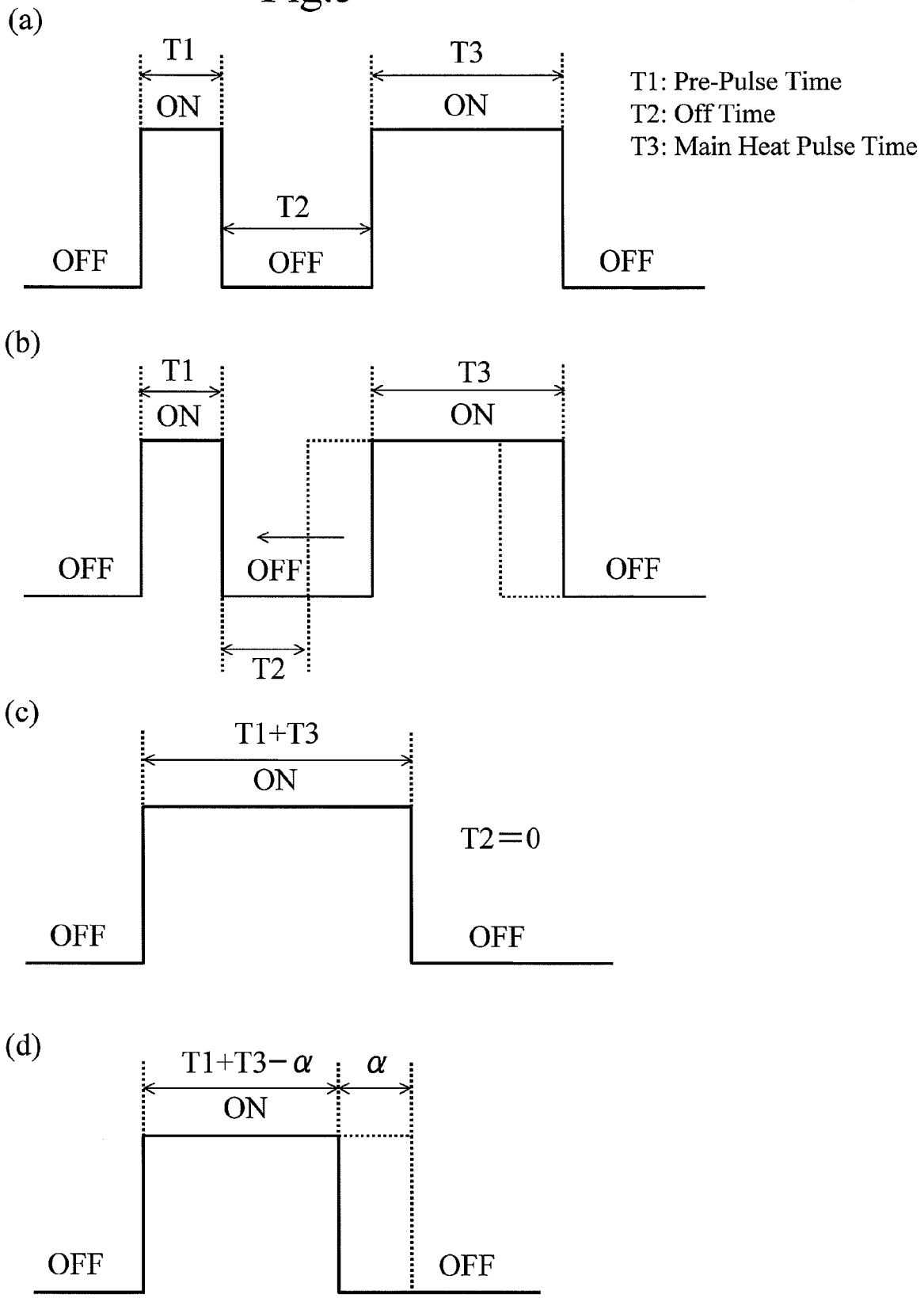
FIG. 5A illustrates an example of the electric pulse applied to a heater.
FIG. 5B illustrates an example of the pulse with the T2 shortened from that in FIG. 5A.
FIG. 5C illustrates an example of the pulse with T2 decreased to zero.
FIG. 5D illustrates an example of the pulse with T2 of zero and T3 shortened.

The change of the timing of the electric pulse to be applied to the heater 152 is described with reference to FIGS. 5-7.

FIG. 5A shows an example of the electric pulse applied to the heater. FIG. 5B shows an example of the pulse with the T2 shortened from that in FIG. 5A. FIG. 5C shows an example of the pulse with the T2 decreased to zero. FIG. 5D shows an example of the pulse with T2 of zero and T3 shortened. FIG. 6 is a graph showing the relation of the ink ejection quantity with the temperature of the recording head. FIG. 7 is an example of the PWM table showing the relation of the temperature of the recording head with the pulse time.

In FIGS. 5A-5D, in the higher portion of the row graph (row denoted by ON), electricity is applied (electric pulse is applied) to the heater 152, whereas in the lower portion of the line graph (line denoted by OFF) electricity is not applied (electric pulse is not applied) to the heater 152.

For ejecting an ink droplet from the nozzle 22K1*n* (FIG. 3) by energizing the heater 152 (FIG. 3), the heating is conducted in three heating time steps: a pre-pulse time T1 (preliminary heating time), an off time T2 (pause-diffusion time), and a main heat-pulse time T3 (heating time for bubbling). In the pre-pulse time T1, an electric current is allowed to flow through the heater 152 (FIG. 3) for the time T1 (heater 152 is energized). The electric current gives a thermal energy to the ink to lower the viscosity of the ink, increasing the ejection efficiency. After the pre-pulse time T1, the heater 152 is turned off during the off time T2 (heater 152 is not energized). After the off time T2, the heater is turned on during the main heat pulse time T3 (heater 152 is energized). In the main heat pulse time T3, the ink is ejected by film boiling of the ink on the surface of the heater 152.

The off time T2 is provided between the pre-pulse time T1 and the main heat pulse time T3 for diffusing the heat applied during the pre-pulse time T1 to the ink in the nozzle to increase the efficiency of the ink ejection. In the present invention, the thermal energy applied to the ink in the nozzle 22K1*n* is controlled by adjusting the off time T2 and/or the main heat pulse time T3 to control the amount of the ink ejection from the nozzle 22K1*n* within a prescribed range.

In the case where the ink droplets are ejected from the recording head repeatedly without pause, the heater 152 (FIG. 3) is energized for a long time to result in rise of the temperature of the whole ink in the nozzle and of the recording head. If the pre-pulse time T1, the off time T2, and the main heat pulse time T3 are kept unchanged, the temperature of the ink in the nozzle rises and the temperature of the recording head rises (the temperatures detected by the temperature detection circuit 170 (FIG. 4)), whereby an excessive thermal energy can be supplied to the ink in the nozzle to increase the amount of the ink droplet ejected from the nozzle. To prevent the increase of the amount of the ink droplet, the off time T2 is shortened.

Figure 6:
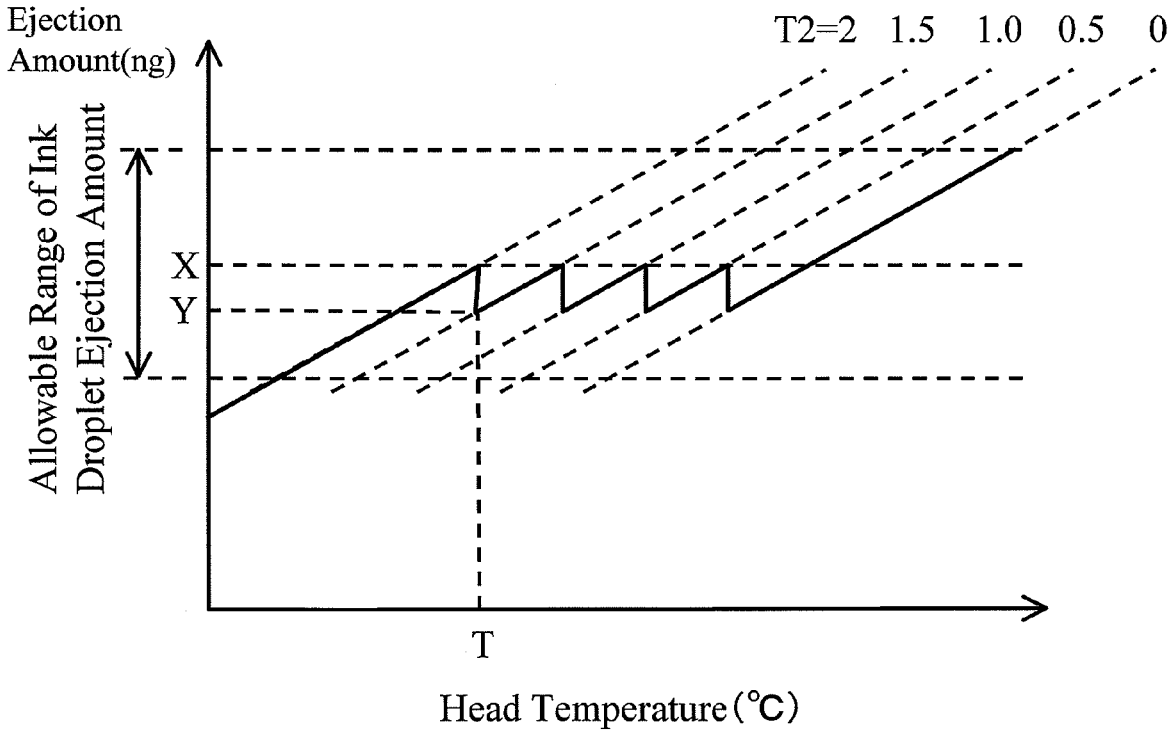
FIG. 6 is a graph showing dependence of the ink ejection amount on the temperature of the recording head (head temperature).

For example, as shown in FIG. 6, at the off time T2 of 2 μsecond, the amount of the ink droplet increases with the rise of the temperature rise of the recording head outside the acceptable range of the ink droplet ejection amount. To keep the amount of the ink droplet within the acceptable range, the off time T2 is shortened stepwise to 1.5 μ-seconds, 1.0 μ-second, 0.5 μ-second, and 0.0 μ-second with the temperature rise of the recording head. If the temperature of the recording head still rises at the off time T2 of zero second ((as shown in FIG. 5C), the time T1+T3 is shortened as shown in FIG. 5D and FIG. 7. For example, as shown in FIG. 7, when the temperature of the recording head rises up to 49° C., the time T3 is shortened by 0.4 μ-second than that at the temperature of the recording head of 43° C.: when the temperature of the recording head rises up to 53° C., the time T3 is shortened by 0.6 μ-second than that at the temperature of the recording head of 43° C. The table shown in FIG. 7 is an example of the PWM table 172 in FIG. 4.

In the present invention, as described above, the amount of the ink droplet ejected from the nozzle is controlled to be within the prescribed range by changing any of the pre-pulse time T1, the off time T2, and the main heat pulse time T3 (off time T2 and/or main heat pulse time T3 in the above description) to change the thermal energy supplied to the ink in the nozzle.

In the ink-jet type image forming method of the present invention, the image formation is conducted by raster division. The raster division is described below with reference to FIG. 8.

Figure 8:
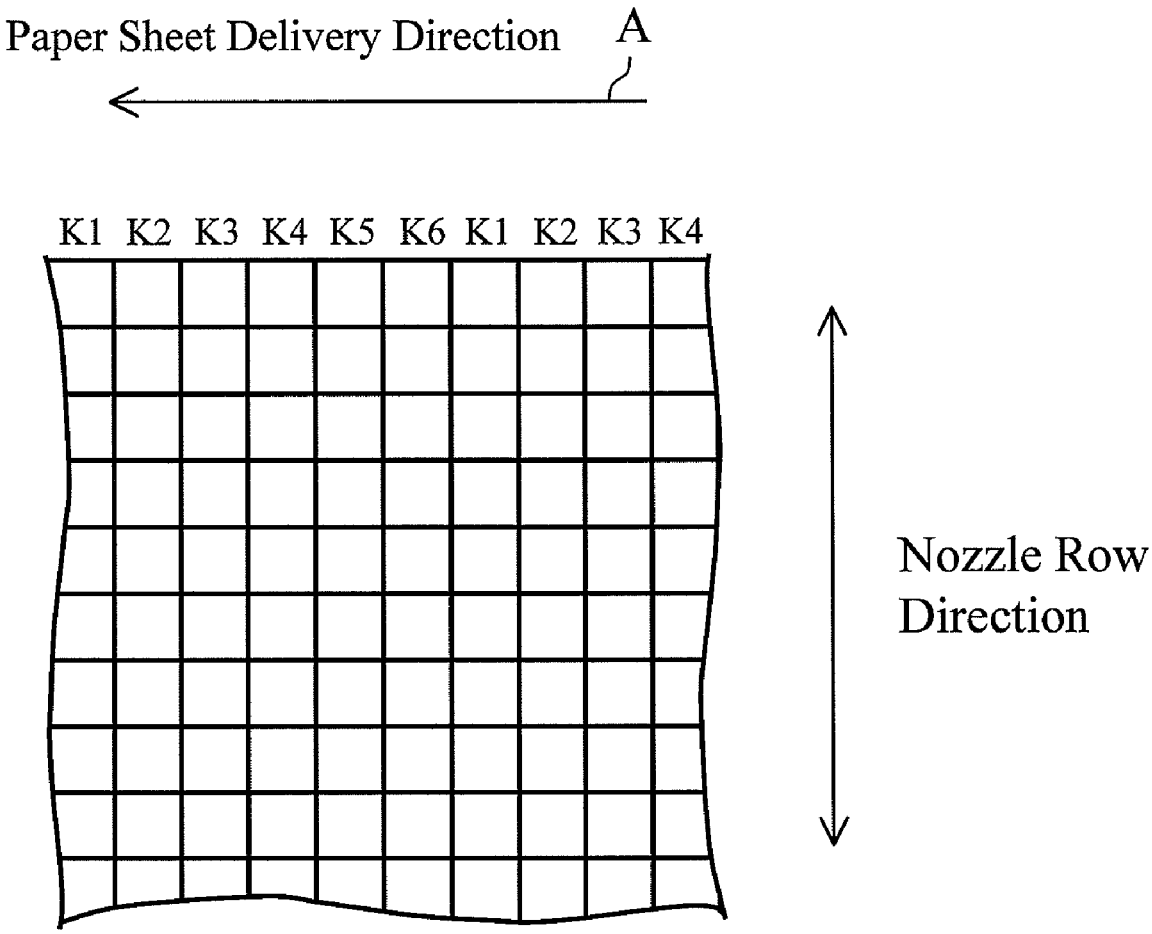
FIG. 8 is a drawing for describing image formation by raster division.

FIG. 8 illustrates a method of image formation by raster division.

In FIG. 8, the nozzle row direction signifies the length direction of the respective recording heads, namely the nozzle arrangement direction. In FIG. 8, the symbols K1, K2, K3, K4, K5, and K6 denote respectively the recording heads 22K1, 22K2, 22K3, 22K4, 22K5, and 22K6 in FIG. 1. In FIG. 8, a small tetragon denotes one picture element. One ink droplet ejected from one nozzle impacts the one picture element. After one printing cycle with the recording heads 22K1-22K6 successively, the printing is conducted again, after the recording head 22K6, starting with 22K1. After finish of printing with the recording head 22K6, the recording medium is delivered by the distance corresponding to the placement space of the recording heads 22K1-22K6.

An example of the ink-jet type image-forming method of the present invention is described with reference to FIGS. 9 and 10.

Figure 9:
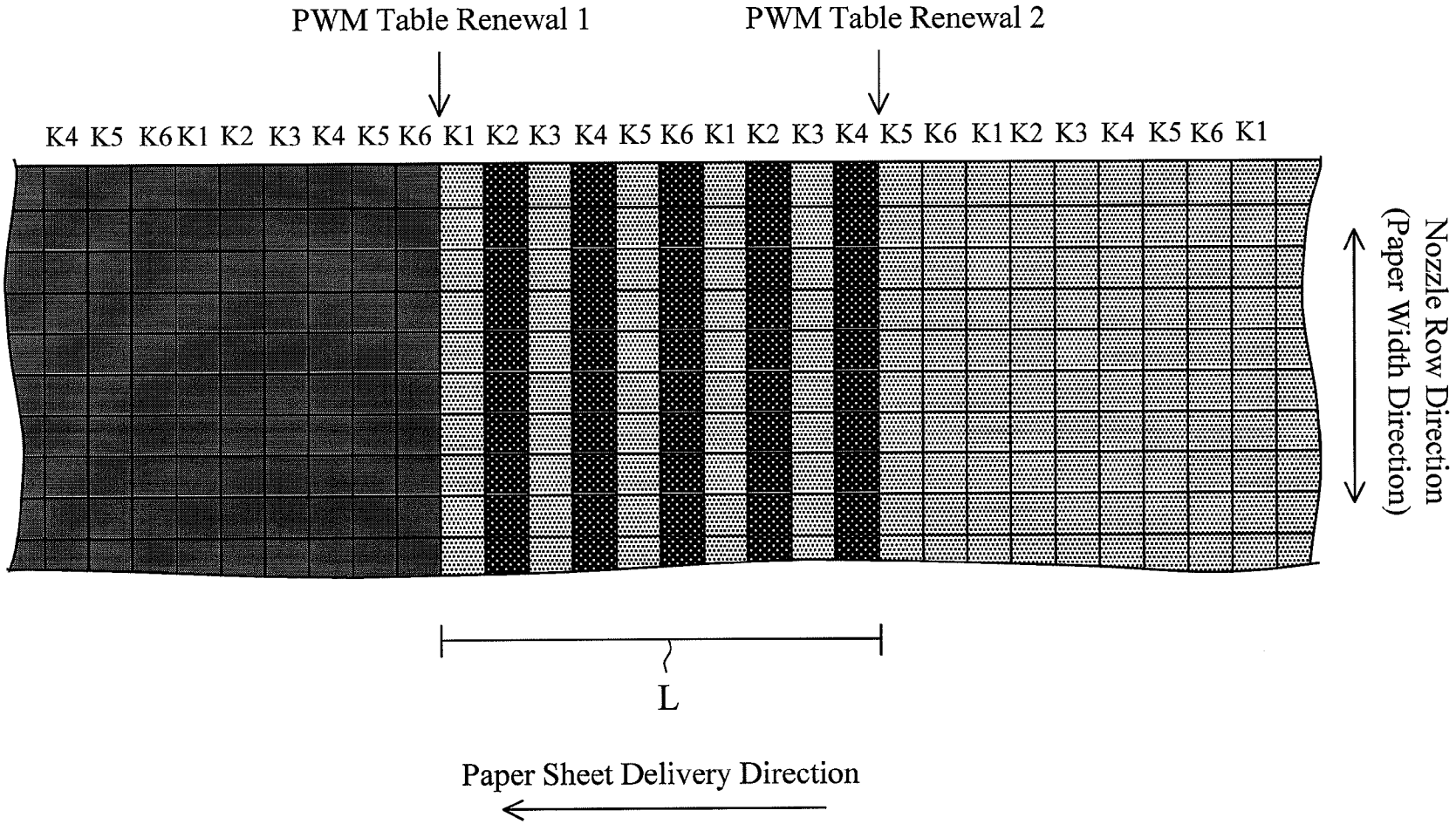
FIG. 9 illustrates an example of the image formed by the ink-jet type image-forming method of the present invention.
Figure 10:
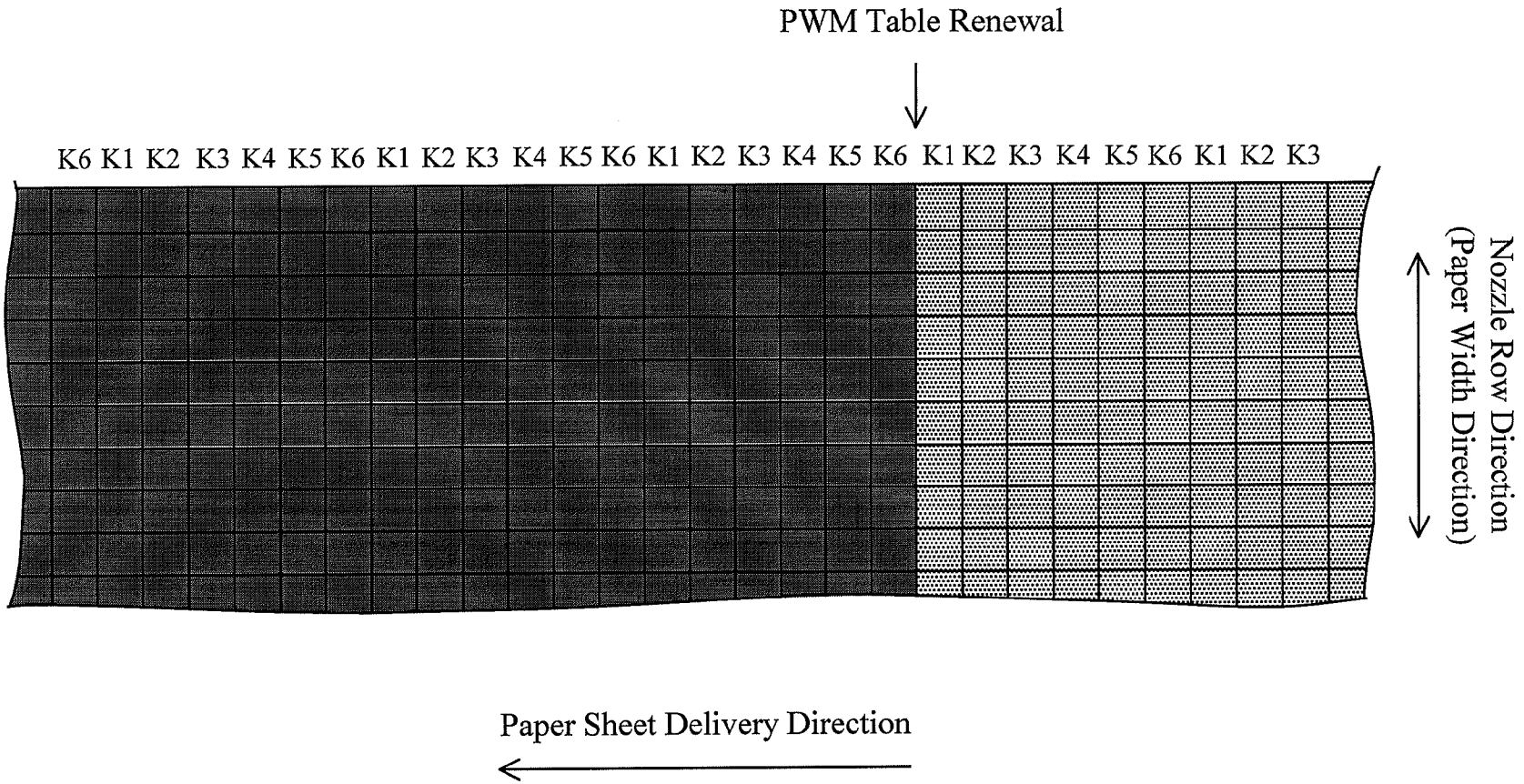
FIG. 10 illustrates an image formed in a comparative example.

FIG. 9 illustrates an example of an image formed by the ink-jet type image-forming method of the present invention. FIG. 10 illustrates an image formed in the comparative example. In FIGS. 9 and 10, the symbols K1-K6 denote respectively the recording heads 22K1-22K6.

In this example, the off time T2 is shortened to prevent increase of the amount of the ink droplet ejected from the nozzle with rise of the temperature of the recording head to control the amount of the ink droplet within the prescribed acceptable range. In this example, the off time T2 is assumed to be changed (the driving conditions are switched) around the head temperature T° C. indicated in FIG. 6. While the temperature of the recording head is slightly lower than T° C., the off time is kept at 2 μ-seconds, and the amount of the ink droplet is about X ng as shown in FIG. 6. When the temperature of the recording head rises above T° C., the off time T2 is adjusted to 1.5 μ-seconds, whereby the amount of the ink droplet is about Y ng as shown in FIG. 6. When the off time T2 is changed (driving conditions are changed; from 2 μ-seconds to 1.5 μ-seconds in this example) simultaneously to change the thermal energy applied to the ink in the nozzles of all the recording heads (six recording heads in this Example), the density is changed distinctly on the recording medium to result in irregularity in the image density to lower the image quality as illustrated in FIG. 10. In this case, at the timing of renewal of the PWM table, T2 is shortened, for example from 2.0 μ-seconds (ink droplet amount of X ng) to 1.5 μ-seconds (ink droplet amount of Y ng), whereby the image density is slightly lowered (in FIG. 10 the density difference is exaggerated).

Therefore in the first example of the present invention, as illustrated in FIG. 9, the amounts of thermal energy applied to the ink in the respective nozzles are not simultaneously changed. Specifically, for example, at the timing of the PWM renewal 1, the off time T2 is shortened in half of the recording heads (in this example, non-adjacent nozzles 22K1, 22K3, and 22K5 from the group of nozzles of 22K1-22K6), whereas in the rest of the recording heads (the group of nozzles of 22K2, 22K4, and 22K6), the off time T2 is not shortened at the timing of the PWM renewal 1, but is shortened at the timing of the PWM renewal 2.

In other words, the driving conditions are not simultaneously changed in all the nozzles (K1, K2, K3, K4, K5, K6, K1, K2, K3, and K4) for ejecting the ink for forming an image in the region having a certain length (L in FIG. 9) in the delivery direction of the recording medium. Herein the word "region" signifies an assemblage of bands, each of the bands being formed by one ejection of ink droplets from one recording head (the band being an arrangement of picture elements perpendicular to the paper sheet delivery direction). The distance L is preferably not less than 10 mm.

As the result, as illustrated in FIG. 9, in the region corresponding to the time between the PWM renewal 1 and the PWM renewal 2 (having the length L in the paper sheet delivery direction and having a width equal to the paper sheet width), the recording heads 22K1, 22K3, and 22K5 eject less amount of ink droplets (for example, the amount a droplet being decreased from X ng to Y ng in FIG. 6). Thereby, the image density formed by the ink droplets ejected from each of the nozzles of the recording heads 22K1, 22K3, and 22K5 becomes lower, although the lowering is hardly recognizable visibly. However, in the region corresponding to the time between the PWM renewal 1 and the PWM renewal 2, the recording heads 22K2, 22K4, and 22K6 eject respectively the ink droplets in a slightly larger amount (for example, slightly larger than X ng in FIG. 6), increasing the image density formed by the ink droplets ejected from the recording heads 22K2, 22K4, and 22K6.

As described above, in the region corresponding to the time between the PWM renewal 1 and the PWM renewal 2 (the region of distance L), the images having a density higher than that before the PWM renewal 1 (left side portion in FIG. 9, formed by recording heads 22K2, 22K4, 22K6) and the images having a density lower than that (formed by recording heads 22K1, 22K3, 22K5) are printed alternately, each image band having the width of the picture element. Therefore, as the entire image, the abrupt change of the image density is not caused in comparison with the image density before and after the two PWM renewals 1 and 2. Thus, the boundary between the regions having the changed image densities is made not visibly recognizable, thereby irregular density and lower image quality being prevented. Further, with the temperature rise of the recording head, the time of energizing the heater is shortened to improve the life of the heater element.

Generally the density irregularity is not visibly distinct at a reflection density difference of not more than Δ=0.1. Therefore, at the boundary between the adjacent regions having different densities, the reflection density difference is preferably controlled to be not more than Δ=0.1, the smaller difference being preferred obviously. The region corresponding to the time between the PWM renewal 1 and the PWM renewal 2 (region corresponding to the length L) can be decided by the pulse driving cycle period, the delivery speed of the recording medium (printing speed), or a like method. The image density can be measured by a densitometer of MacBeth Co. (MacBeth Co., Model RD918).

A process of the ink-jet type image-forming method of the present invention is described with reference to FIG. 11.

Figure 11:
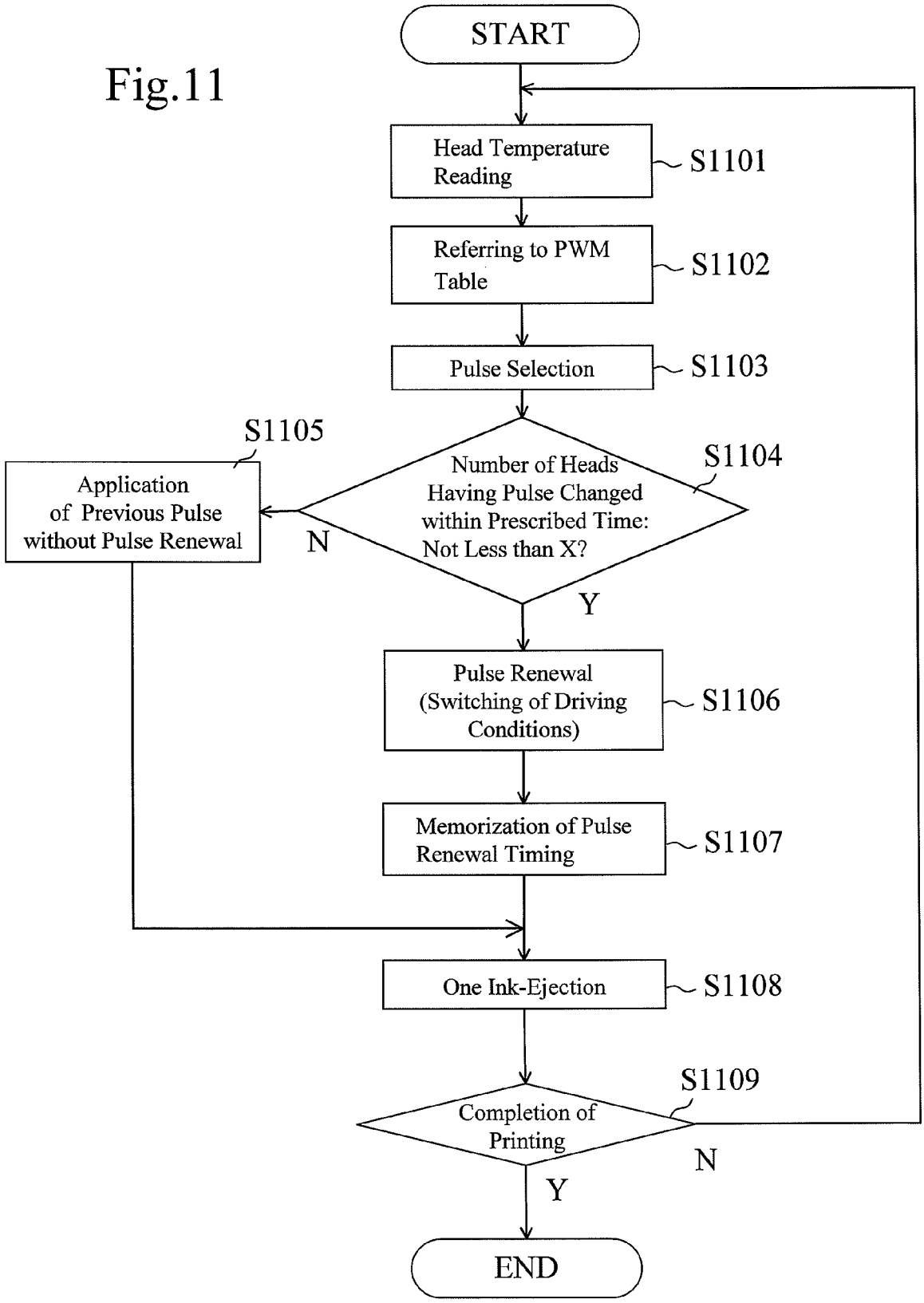
FIG. 11 is a flow chart of a process of the ink-jet type image forming method of the present invention.

FIG. 11 is a flow chart of a process of the ink-jet type image-forming method of the resent invention. This flow chart shows a process in one recording head from start to end of ink ejection. In other recording heads, the process is the same.

This flow is started by pressing a print-starting button to transmit a signal of start of the printing to a recording head-controlling circuit 112 (FIG. 2). On pressing the print-starting button, the temperature-detecting circuit 170 detects the temperature of the recording head according to the signal from a Di sensor 168 (FIG. 4) (S1101). In this flow, the temperature of the recording head is detected after every ejection of ink (S1101). After the step S1101, based on the detected temperature, the PWM table 172 (FIG. 4) is referred to (S1102). Thereby, the off time T2 and the main heat pulse time T3 (pulses for giving the thermal energy to the ink in the nozzles) are selected (S1103). The number (X) of the heads (e.g., three heads) in which the pulse has been changed within a certain time (e.g., 0.1 seconds) is determined (S1104). When the number of the heads is found to be more than prescribed number X, the pulse is not renewed, and the ink is ejected once from the nozzles with the preceding pulses without the pulse renewal (S1108).

When the number of the heads is found to be not more than X, the pulses for those heads only are renewed (S1106). The wording of "those nozzle only" signifies that the pulse is not simultaneously renewed in all the recording heads. Thus the thermal energy for all the recording heads is not changed simultaneously. The recording head or heads in which the pulse is changed are preliminarily decided and the information on the heads is memorized in a pulse-changing circuit 174 (FIG. 4). In this memorization, in a printer 10 having recording heads 22K1-22K6 as illustrated in FIG. 1, for example, the memorization is made not to change the pulse simultaneously in the adjacent nozzles such as the recording heads 22K1 and 22K2. More specifically, the recording heads 22K1, 22K3, and 22K5 may be classified as group I, and the recording heads 22K2, 22K4, and 22K6 may be classified as group II. Even when the temperatures of all of the recording heads 22K1-22K6 reach or exceed the temperature to change the pulses, the pulses are changed in the recording heads of group I only, whereas the pulses in the recording heads of group II are kept unchanged. Then step S1107 is conducted. As described later, the pulse change may be preliminarily decided for the respective nozzles of one recording head. For example, in one row of the nozzles of one head, alternate nozzles may be classified as one group: even-numbered nozzles from the one end of the nozzle row may be classified as group I, and odd-numbered nozzles may be classified as group II.

After renewal of the pulses in the prescribed recording heads in the step S1106, the individual nozzles in which the pulse has been changed and the timing of the change (change time) are memorized in the pulse changing circuit 178 (FIG. 4) (S1107). According to the memory, determination can be made whether or not the number of the heads in which the pulse has been changed within a prescribed time is X (e.g., three heads) or less. Next to the step S1107, the ink is ejected (one ink-ejection from the nozzles) with the prescribed pulse widths (S1108). The completion of the printing by the one ink-ejection for formation of the intended image is determined (S1109). When the printing is found not to have been completed, the flow is conducted again from S1101, whereas when the printing is found to have been completed, the flow is finished.

Example 2

Example 2 of the present invention is described with reference to FIG. 12.

Figure 12:
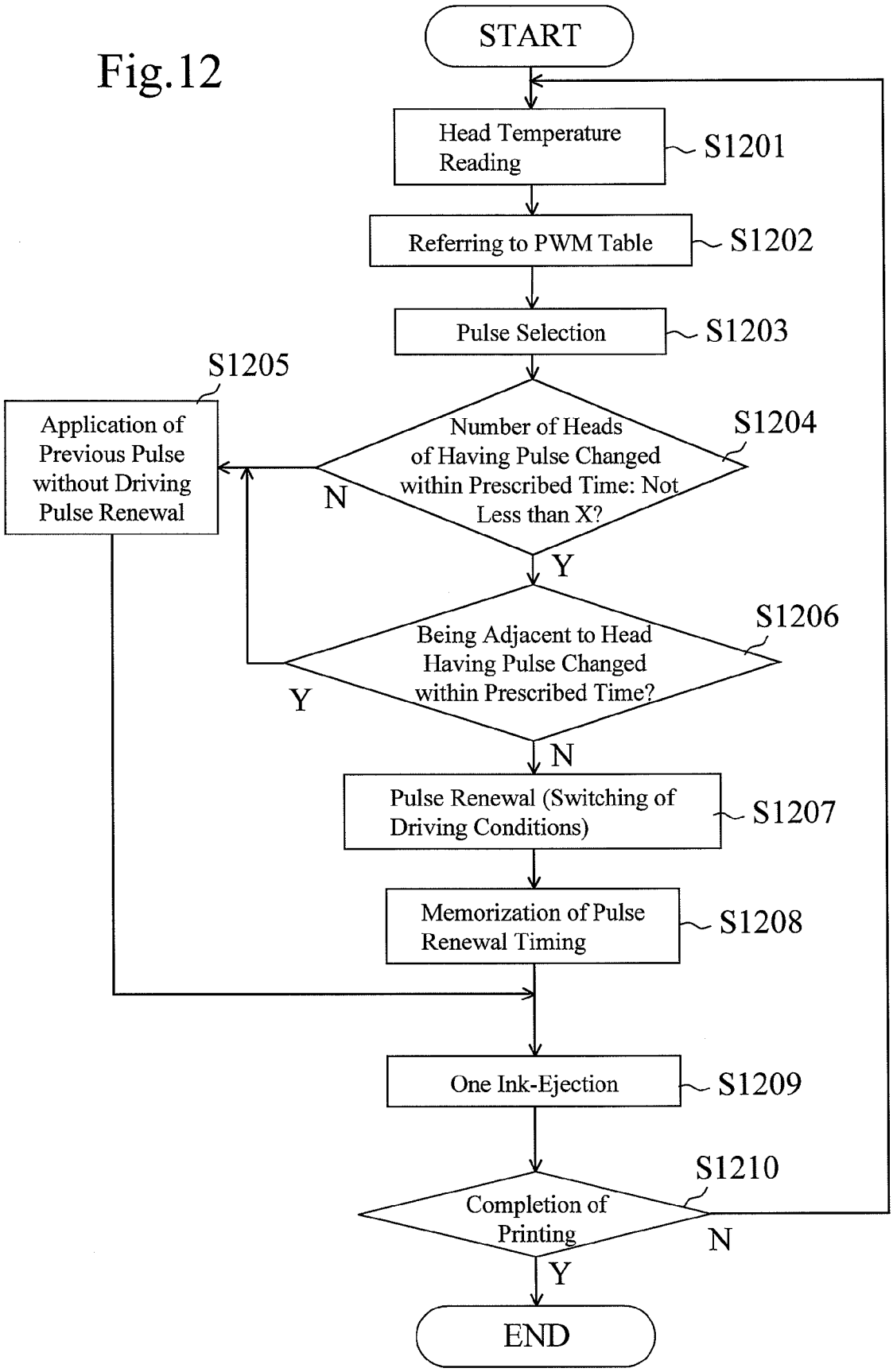
FIG. 12 is a flow chart of another process of the ink-jet type image-forming method of the present invention.

FIG. 12 is a flow chart of another process of the ink-jet type image-forming method of the present invention.

This flow is started by pressing a print-starting button to transmit a signal of start of the printing to a recording head-controlling circuit 112 (FIG. 2). On pressing the print-starting button, the temperature-detecting circuit 170 detects the temperature of the recording head according to the signal from a Di sensor 168 (FIG. 4) (S1201). In this flow, the temperature of the recording head is detected after every ejection of ink (S1201). After the step S1201, based on the detected temperature, the PWM table 172 (FIG. 4) is referred to (S1202). Thereby, the off time T2 and the main heat pulse time T3 (pulses for giving the thermal energy to the ink in the nozzles) are selected (S1203). The number (X) of the heads (e.g., three heads) in which the pulse has been changed within a prescribed time (e.g., 0.1 seconds) is determined (S1204). When the number of the heads is found to be more than prescribed number X, the pulse is not renewed, and the ink is ejected once from the nozzles without the pulse renewal (S1209).

When the number of the heads is found to be not more than X in the step of S1204, the recording head or heads in which the pulse is intended to be changed are checked whether or not the heads are adjacent to the aforementioned head in which the pulse has been changed within the prescribed time (S1206). When they are found to be adjacent to each other, the ink (ink droplets) is ejected once from the nozzles (S1209) without change of the pulses in the head in which the pulses are intended to be changed (S1205). When they are found to be not adjacent to each other, the pulses are changed in the head in which the pulses are intended to be changed (S1207). Then the individual recording head in which the pulses have been changed and the timing of the change are memorized in the pulse change circuit 178 (FIG. 4) (S1208). Based on the memory, the prescribed times in the steps S1204 and S1206 are decided.

Next to the step S1208, the ink is ejected once from the nozzles with the prescribed pulse widths (S1209). The completion of the printing by the one ink-ejection for formation of the intended image is determined (S1213). When the printing is found not to have been completed, the flow is conducted again from the step S1201, whereas when the printing is found to have been completed, the flow is finished.

In the above flow, the pulses are changed in the recording head, only when the recording head in which the pulses are intended to be changed and the recording head in which the pulses have been changed within the above prescribed time are not adjacent to each other. In such a flow, as shown in FIG. 9, in the region corresponding to the time between the PWM renewal 1 and the PWM renewal 2 (the region having the width of the recording paper sheet and the length L in the recording sheet delivery direction), the abrupt change of the image density is not caused in comparison with the densities of the images formed before and after the two PWM renewals 1 and 2. Thus, the boundary between the regions having changed image densities on one recording medium is made not visibly recognizable, thereby irregular density and lower image quality being prevented.

In the example illustrated in FIG. 9, the three recording heads 22K1, 22K3, and 22K5 are classified as a first group and the rest of the recording heads 22K2, 22K4, and 22K6 are classified as a second group. Otherwise, the grouping of the recording heads may be changed during the printing. This example is described with reference to FIG. 13.

Figure 13:
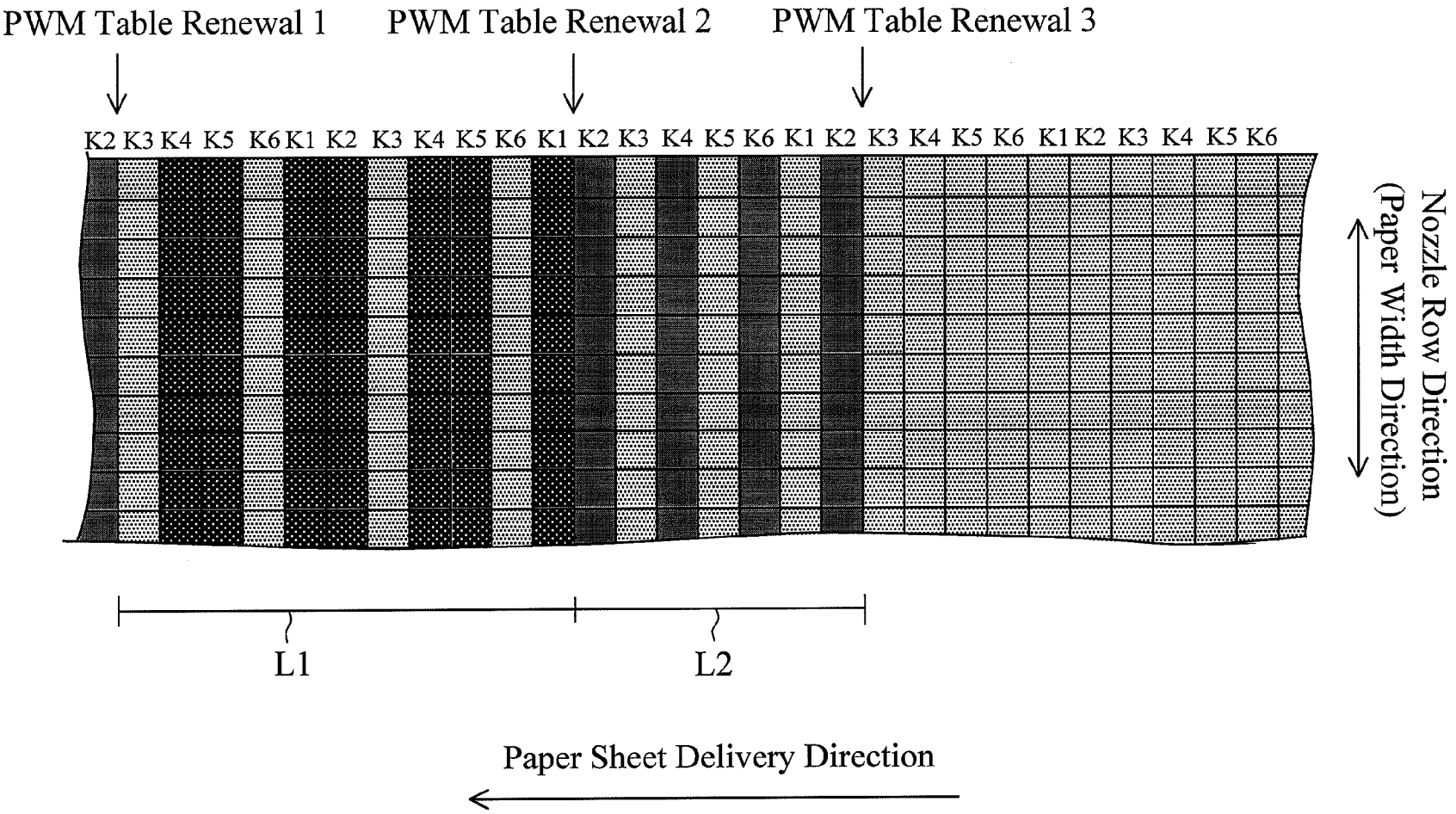
FIG. 13 shows an example with a changed combination of the head groups.

In the example illustrated in FIG. 13, at the time of the PWM table renewal 1, the recording heads 22K3 and 22K6 are classified as one group and other recording heads 22K1, 22K2, 22K4, and 22K5 are classified as the other group. In the PWM table renewal 1, the temperatures of the recording heads 22K3 and 22K6 only are referred to and the pulses therein are changed (the driving conditions are changed). At the PWM table renewal 2, three recording heads 22K1, 22K3, and 22K5 are classified as one group, and 22K2, 22K4, and 22K6 are classified as the other group, and the pulses in all the recording heads are changed with reference to the temperatures of all of the recording heads.

Before and at the step of PWM table renewal 1 (in FIG. 13, formation of the image indicated by the leftmost K2), the amount of the ejected ink droplets is assumed to have increased with rise of the temperature of the recording head, for example, to X ng in FIG. 6. At this step, to decrease the entire amount of the ink droplet ejection in the region corresponding to the time between the PWM table renewal 1 and the PWM table renewal 2, the amount of the ink droplet ejection is decreased at the recording heads 22K3 and 22K6 only (for example, from X ng to Y ng in FIG. 6). However, the amount of the ink droplet ejection from other four recording heads 22K1, 22K2, 22K4, and 22K5 still increases with the rise of the temperature (for example, slightly larger than X ng in FIG. 6).

In the above recording, in the region corresponding to the time between the PWM renewal 1 and the PWM renewal 2 (the region having the same width as the recording medium and a length L1 in the paper sheet delivery direction), images (images formed by recording heads 22K1, 22K2, 22K4, and 22K5) of the density higher than that before the timing of PWM renewal 1 (in FIG. 13, the leftmost image indicated by K2) and images (images formed by recording heads 22K3, and 22K6) of the density lower than that are formed alternately in a band width corresponding to the width (or double the width) of the picture element. Consequently, as the entire image, in the region corresponding to the time between the PWM renewal 1 and the PWM renewal 2, the image density does not change abruptly from the density of the image formed before the PWM renewal 1.

Similarly as above, in the region corresponding to the time between the PWM table renewal 2 and the PWM table renewal 3 (the region having the same width as the recording medium and a length L2 in the paper sheet delivery direction), the image density does not change abruptly from that formed between the timing of PWM renewal 1 and the timing of PWM renewal 2. Similarly in the region formed after the PWM table renewal 3 (region at the right portion in FIG. 13), the image density does not change abruptly from that formed between the timing of the PWM renewal 2 and the timing of the PWM renewal 3. Such change of the grouping of the recording heads in two steps further decreases the change of the image density, making the image density changing boundary less visibly recognizable, and preventing the density irregularity and deterioration of the image quality.

In the above example, the pulses are changed in all the nozzles in one recording head. However, the nozzles in the one recording head are classified into groups and the timing of the pulse change may be changed for the groups. This is described below with reference to FIG. 14.

Figure 14:
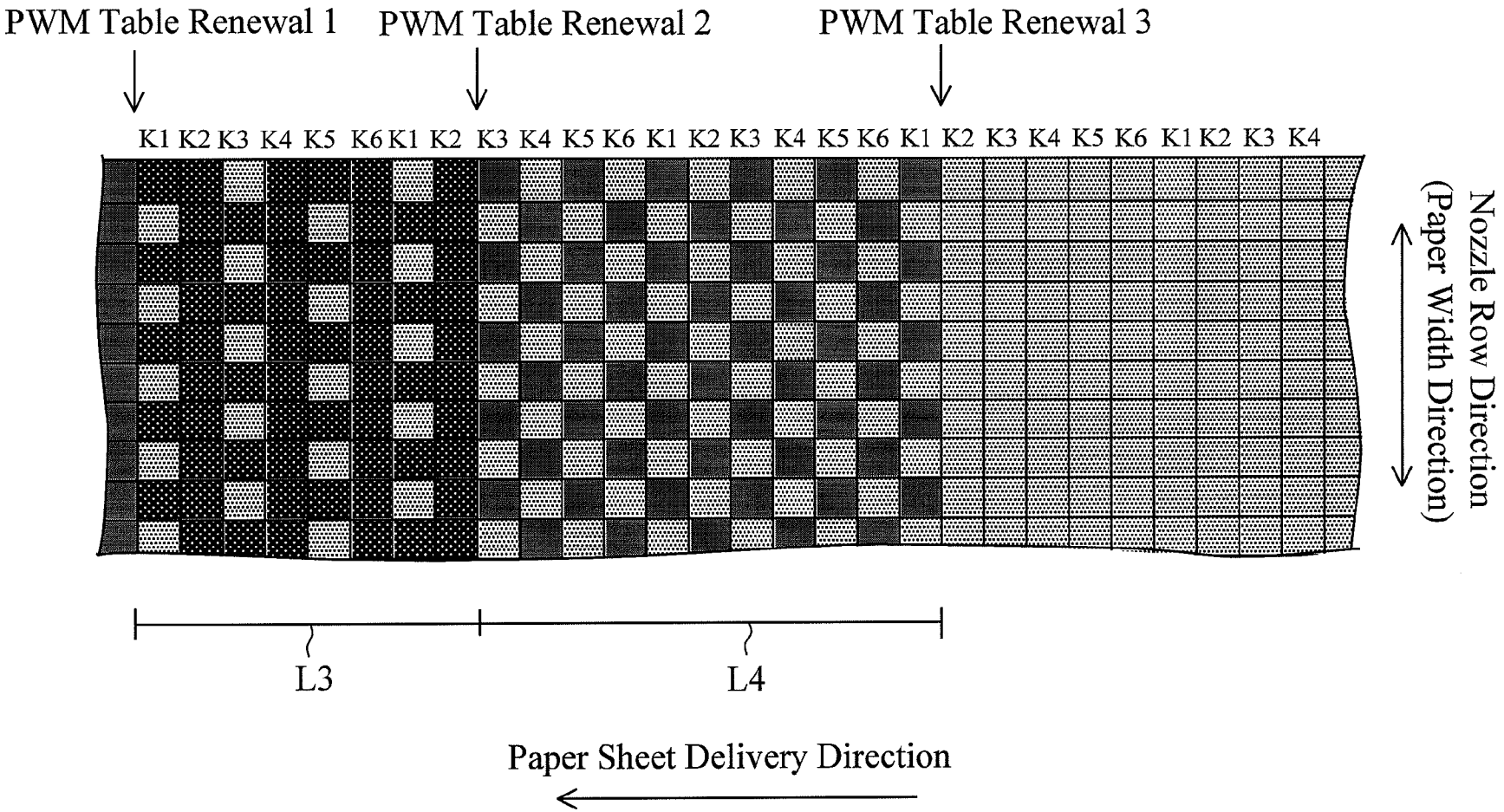
FIG. 14 illustrates an example of an image formed by the ink-jet type image-forming method of the present invention.

FIG. 14 illustrates an image formed by the ink-jet type image-forming method of the present invention. In FIG. 14, the symbols K1-K6 denote the recording heads 22K1-22K6.

At the step of the PWM table renewal 1 (for the region having the width of the recording medium and a length L3 in the recording paper sheet delivery direction), the recording heads 22K1, 22K3 and 22K5 are classified as one group and other recording heads 22K2, 22K4, and 22K6 are classified as the other group. In the step of the PWM table renewal 1, the temperatures of the recording heads 22K1, 22K3, and 22K5 are referred to and the pulses therein are changed, but within the respective recording heads, only the temperatures of one group of the alternately adjacent nozzles are referred to and the pulses therein are changed, whereas the pulses are not changed in the other group of the alternately adjacent nozzles. At the step of the PWM table renewal 2 (for the region having the width of the recording medium and a length L4 in the recording paper sheet delivery direction), the pulses in all the recording heads are changed by referring to the temperatures of all the recording heads 22K1-22K6, but within the respective recording heads, only the temperature of one group of the alternately adjacent nozzles is referred to and the pulses therein are changed, whereas the pulses are not changed in the other group of the alternately adjacent nozzles; and in the adjacent recording heads, only the temperatures of one group of the alternately adjacent nozzles are referred to and the pulses therein are changed.

As described above, in the case where the grouping of the nozzles is changed in two steps and the pulses are kept unchanged in one group of alternately adjacent nozzles, the change of the image density is further reduced, which makes the boundary of the image density change less recognizable visibly and prevents further the density irregularity and deterioration of the image quality.

Figure 15:
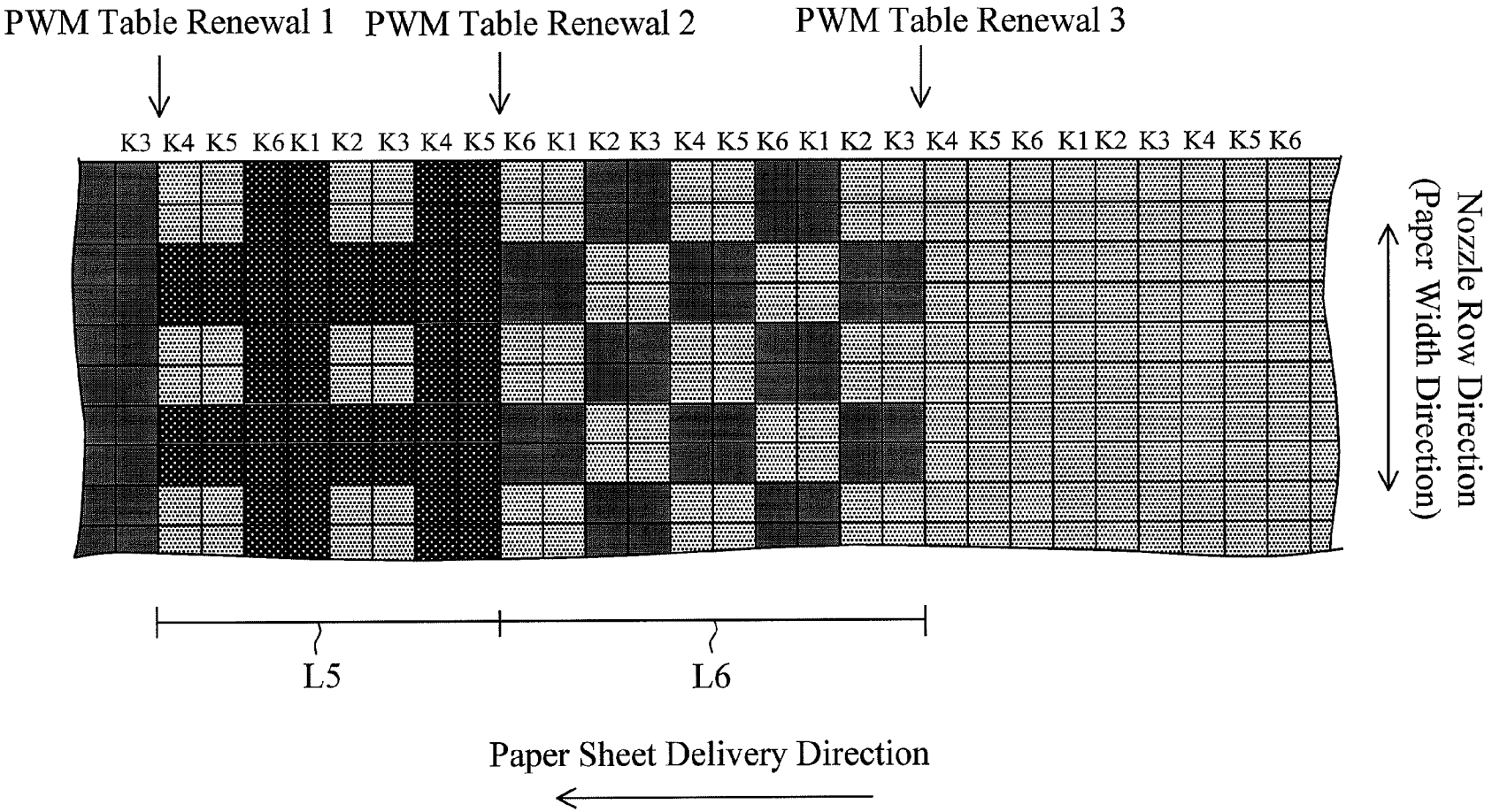
FIG. 15 illustrates another example of an image formed by the ink-jet type image-forming method of the present invention.

An example is described in which the pulses are changed simultaneously in a part of the nozzles in adjacent recording heads with reference to FIG. 15.

FIG. 15 illustrates an example of an image formed by the ink-jet type image-forming method of the present invention. In FIG. 15, the symbols K1-K6 denote the recording heads 22K1-22K6.

At the step of the PWM table renewal 1 (for the region having the width of the recording medium and a length L5 in the recording paper sheet delivery direction), two recording heads adjacent to each other (22K4 and 22K5 at the leftmost side in the region of the length L5 in this example) are classified as a first group; the following two recording heads (22K6 and 22K1 in the left side in the region of the length L5) are classified as a second group; the next following two recording heads (22K2 and 22K3 at the left side in the region of the length L5) are classified as a third group; and the next following two recording heads (22K4 and 22K5 in the right side in the region of the length L5) are classified as a fourth group. In the step of the PWM table renewal 1, the temperatures of the recording heads 22K2, 22K3, 22K4, and 22K5 are referred to and the pulses therein are changed, but of the all nozzles in the adjacent recording heads (22K4 and 22K5, and 22K2 and 22K3), two adjacent nozzles are combined as one pair, and the pulses are not changed in alternate pairs of the nozzles.

At the step of the PWM table renewal 2 (for the region having the width of the recording medium and a length L6 in the recording paper sheet delivery direction), the pulses in all the recording heads are changed by referring to the temperatures of all the recording heads 22K1-22K6. In this pulse change, of all the nozzles in the adjacent recording heads (22K4 and 22K5, 22K2 and 22K3, and 22K6 and 22K1), adjacent two nozzles are combined in pairs, and the pulses are not changed in alternate nozzle pairs. The above nozzle grouping reduces further the change of the image density, making the boundary of the image density change less recognizable visibly and preventing further the density irregularity and deterioration of the image quality.

Figure 16:
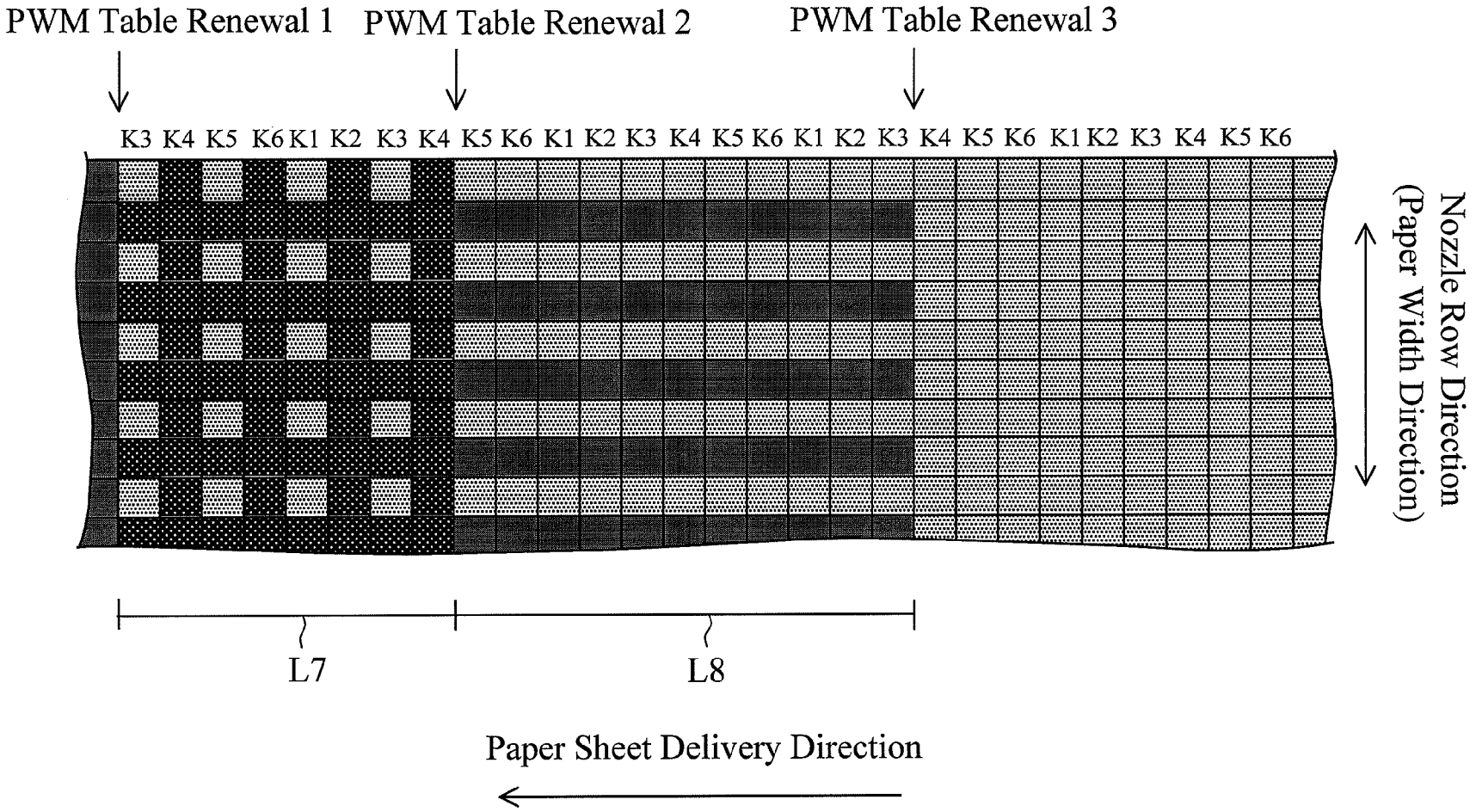
FIG. 16 illustrates a still another example of an image formed by the ink-jet type image-forming method of the present invention.

An example is described in which the pulses are changed not simultaneously in the adjacent nozzles in one recording head with reference to FIG. 16.

FIG. 16 illustrates an example of an image formed by the ink-jet type image-forming method of the present invention. In FIG. 16, the symbols K1-K6 denote the recording heads 22K1-22K6.

At the step of the PWM table renewal 1 (for the region having the width of the recording medium and a length L7 in the recording paper sheet delivery direction), the recording heads 22K1, 22K3, and 22K5 are classified as a first group, and recording heads 22K2, 22K4, and 22K6 are classified as a second group. In the step of the PWM renewal 1, the temperatures of the recording heads 22K1, 22K3, and 22K5 are referred to and the pulses therein are changed, but within one recording head, the pulses are changed alternately in the adjacent nozzles.

At the step of the PWM table renewal 2 (for the region having the width of the recording medium and a length L8 in the recording paper sheet delivery direction), the pulses in all the recording heads are changed by referring to the temperatures of all the recording heads 22K1-22K6. In this pulse change, in one recording head, pulses are changed in alternate nozzles, and in adjacent nozzles of adjacent recording heads, the pulses are changed simultaneously as one nozzle group. The above nozzle grouping reduces further the change of the image density, making the boundary of the image density change less recognizable visibly and preventing further the density irregularity and deterioration of the image quality. In the above examples, plural recording heads are employed. However, similar control can be conducted with one-body type recording head having plural rows of nozzles.

As described above, during a long time of running of an ink-jet type image-forming apparatus, the temperature of the recording head rises gradually. The gradual temperature rise causes gradual increase of the size (amount) of the ejected ink droplet, increasing the image density correspondingly. To prevent this undesired increase of the image density, the heating pulses to be applied to the respective nozzles are changed with the rise of the temperature to decrease the heat generation to keep the amount of the ink ejection within a certain range. However, if the heating pulses are changed simultaneously in all the nozzles of all the recording heads, the image density changes abruptly to be visibly recognizable, lowering the image quality. On the other hand, according to the present invention, the thermal energy applied to the ink in all the nozzles is not simultaneously changed, so that abrupt change of the image density will not be caused. Further according to the present invention, the number of the nozzles in which the thermal energy applied to the ink is increased successively gradually to all the nozzles, so that the boundary line of the image density change is hardly recognizable not to cause the image density.

What is claimed is:

1. An ink-jet type image-forming apparatus, comprising:

a plurality of recording heads each having a plurality of nozzles for ink ejection, each of the nozzles being provided with a heater element on an inside wall thereof, electric pulses being applied to the heater elements to heat up and to eject ink droplets therefrom; and a delivery mechanism which delivers a recording medium in a delivery direction perpendicular to a row direction in which the nozzles are arranged;

wherein different ones of the plurality of recording heads print a plurality of regions on the recording medium adjacently arranged in the delivery direction;

the apparatus further comprising:

a pulse-applying circuit which applies the electric pulses to the heater elements provided on the plurality of recording heads; and a pulse-changing circuit which causes the pulse-applying circuit to change the electric pulses applied therefrom;

wherein the pulse-changing circuit is adapted to cause, in case changing an electric pulse to be applied to the heater elements of all the recording heads from a first electric pulse to a second electric pulse which differs from the first electric pulse, the pulse-applying circuit to apply the second electric pulses to the heater elements of all the recording heads after a prescribed delivery length of regions including a plurality of print regions that are adjacent with each other have been printed with the plurality of recording heads;

wherein the pulse-changing circuit causes, in the printing of the prescribed delivery length of regions so as to perform a printing operation, for one of the plurality of prescribed regions, the pulse-applying circuit to apply, to the heater elements of one of the recording heads, the second electric pulse changed from the first electric pulse; and the pulse-changing circuit causes, for the other of the plurality of prescribed regions, the pulse-applying circuit to apply, to the heater elements of the other of the recording heads, the first electric pulse without changing to the second electric pulse; and wherein the plurality of recording heads print first and second print regions within the prescribed delivery length, the first and second regions being alternately placed, the first print region being printed with the second electric pulse applied to the heater elements of the recording heads, and the second print region being printed with the first electric pulse applied to the heater elements of the recording heads.

2. The ink-jet type image-forming apparatus according to claim 1, wherein the plurality of recording heads are classified into a plurality of groups, and one of plural types of electric pulse is selected for each of the groups.

3. The ink-jet type image-forming apparatus according to claim 1, wherein the plurality of recording heads are classified into a plurality of groups, each group including recording heads that are placed at positions not adjacent with each other, and one of plural types of electric pulse is selected for each of the groups.

4. The ink-jet type image-forming apparatus according to claim 1, wherein regions to be printed by adjacent ones of the nozzles are printed with one type of electric pulse selected at different timings from plural types of electric pulse.

5. The ink-jet type image-forming apparatus according to claim 1, wherein one of plural types of electric pulse is selected based on a temperature of ink of the recording heads.

* * * * *